US007355564B2

(12) United States Patent
Kang et al.

(10) Patent No.: US 7,355,564 B2
(45) Date of Patent: Apr. 8, 2008

(54) PLASMA DISPLAY PANEL AND DRIVING METHOD THEREOF

(75) Inventors: Kyoung-Ho Kang, Suwon-si (KR); Woo-Joon Chung, Asan-si (KR); Jin-Sung Kim, Cheonan-si (KR); Seung-Hun Chae, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 642 days.

(21) Appl. No.: 10/902,876

(22) Filed: Aug. 2, 2004

(65) Prior Publication Data

US 2005/0040770 A1 Feb. 24, 2005

(30) Foreign Application Priority Data

Aug. 5, 2003 (KR) ..... 10-2003-0054058

(51) Int. Cl.
*G09G 3/28* (2006.01)

(52) U.S. Cl. ..... 345/60; 345/62; 345/63; 345/37; 345/41

(58) Field of Classification Search ..... 345/37, 345/41–42, 55, 60–69, 690–693
See application file for complete search history.

(56) References Cited

U.S. PATENT DOCUMENTS

| | | | | |
|---|---|---|---|---|
| 5,745,086 | A * | 4/1998 | Weber | 345/63 |
| 6,249,087 | B1 * | 6/2001 | Takayama et al. | 315/169.1 |
| 6,784,858 | B2 * | 8/2004 | Awamoto | 345/60 |
| 6,822,644 | B1 * | 11/2004 | Awamoto et al. | 345/211 |
| 2003/0107532 | A1 * | 6/2003 | Choi | 345/60 |
| 2004/0252081 | A1 * | 12/2004 | Choi | 345/60 |
| 2005/0052354 | A1 * | 3/2005 | Chae et al. | 345/60 |
| 2005/0073480 | A1 * | 4/2005 | Kim et al. | 345/60 |
| 2005/0083259 | A1 * | 4/2005 | Kim et al. | 345/60 |
| 2005/0110713 | A1 * | 5/2005 | Chung et al. | 345/60 |
| 2005/0156823 | A1 * | 7/2005 | Kang et al. | 345/60 |
| 2005/0162346 | A1 * | 7/2005 | Han et al. | 345/60 |
| 2005/0225505 | A1 * | 10/2005 | Lee | 345/60 |

FOREIGN PATENT DOCUMENTS

| | | |
|---|---|---|
| JP | 08-320669 | 12/1996 |
| JP | 2001-013912 | 1/2001 |
| JP | 2002-132208 | 5/2002 |
| JP | 2002-215090 | 7/2002 |
| JP | 2002-258794 | 9/2002 |
| JP | 2003-015599 | 1/2003 |
| JP | 2003-029700 | 1/2003 |
| JP | 2003-084712 | 3/2003 |

* cited by examiner

*Primary Examiner*—Alexander Eisen
*Assistant Examiner*—Jason M Mandeville
(74) *Attorney, Agent, or Firm*—H.C. Park & Associates, PLC

(57) ABSTRACT

A plasma display panel (PDP) and driving method that includes a floating reset process. A number of subfields are generated from input video signals, and subfield data for each subfield are output. A first voltage is applied to the first electrode according to sustain information to cause a discharge in a first discharge space, and the first electrode is floated during a period which corresponds to subfield data of a previous subfield. During this process, the floating time is controlled according to the number of addressed cells called for in previous subfield data.

15 Claims, 6 Drawing Sheets

PLASMA DISPLAY PANEL AND DRIVING METHOD THEREOF

CROSS REFERENCE TO RELATED APPLICATION

This application claims priority to and the benefit of Korea Patent Application No. 2003-54058 filed on Aug. 5, 2003 in the Korean Intellectual Property Office, the content of which is incorporated herein by reference.

BACKGROUND OF THE INVENTION (a) Field of the Invention

The present invention relates to a plasma display panel (PDP) and a PDP driving method.

(b) Description of the Related Art

The POP is a flat panel display that uses plasma generated via a gas discharge process to display characters or images. Depending on the size of the POP, tens to millions of pixels (i.e., picture elements) are provided, arranged in a matrix format. POPs are categorized as either Direct Current (DC) or Alternating Current (AC) PDPs, depending on the voltage waveforms used to drive the PDP and the structure of the individual discharge cells.

In general, the AC PDP driving method uses sequential reset periods, address periods, and sustain periods. During the reset period, wall charges formed by a previous sustain are erased, and cells are reset so as to perform the next address operation readily. During the address period, cells that are to be activated and those that are to remain inactive are selected, and wall charges are accumulated in the activated cells (i.e., addressed cells). During the sustain period, a discharge is created in the addressed cells in order to display images. When the sustain period begins, sustain pulses are alternately applied to the scan electrodes and sustain electrodes to perform the sustaining operation and, thus, display the images.

Conventionally, a ramp waveform is applied to a scan electrode so as to establish wall charges in the reset period. More particularly, a gradually rising ramp waveform is applied to the scan electrode, followed by a gradually falling ramp waveform. Typically, precise control over the wall charges depends on the gradient of the ramp.

SUMMARY OF THE INVENTION

One aspect of the invention relates to a plasma display panel. The plasma display panel comprises a plurality of address electrodes, and corresponding pluralities of scan electrodes and sustain electrodes arranged in pairs, a controller, an address data driver, a sustain electrode driver, and a scan electrode driver. The controller is adapted to accept external video signals and generate and output subfield data and sustain pulse information corresponding to the respective subfields. The controller is also adapted to control voltage application such that a floating state and a voltage application state are repeatedly alternated to bring at least one electrode from a first voltage to a second voltage in the reset period, and to control a voltage application period for the voltage application state or a floating period for the floating state according to the subfield data. The subfield data comprises at least the number of addressed cells called for in previous subfield data. Additionally, the controller is adapted to output a control signal embodying the control of voltage application and the control of the voltage application time or floating time. The address data driver is adapted to apply a voltage that corresponds to the subfield data to the address electrode. The sustain electrode driver is adapted to apply sustain voltages to the sustain electrode according to the sustain pulse information output by the controller. The scan electrode driver is adapted to control the floating period or the voltage application period according to the control signal, and to apply scan voltages to the scan electrode according to the sustain pulse information.

Another aspect of the invention relates to a plasma display panel that translates input video signals into subfield data, divides each subfield datum into a reset period, an address period, and a sustain period, and produces an image using the subfield data. The plasma display panel comprises a first electrode, a second electrode, and a third electrode; one or more discharge spaces defined, at least in part, by the electrodes; and a driving circuit. The driving circuit is adapted to transmit a driving signal to the first and second electrodes during the reset period, the driving signal causing a floating state and a voltage application state to be repeatedly alternated to bring the first electrode from a first voltage to a second voltage during the reset period, such that the duration of at least one of the voltage application state or the duration of the floating state is determined in accordance with a number of addressed cells called for in previous subfield data.

Yet another aspect of the invention relates to a method for driving a plasma display panel. The plasma display panel includes a first space defined by a first electrode, a second electrode, and a third electrode. The method comprises creating a number of subfields from input video signals, dividing each subfield into a reset period, an address period, and a sustain period, outputting sustain pulse information for each subfield, generating subfield data for the number of subfields, and applying the subfield data to the third electrode. The method also comprises applying a voltage which repeats a floating state and a voltage application state to cause the voltage at the first electrode to move from a first voltage to a second voltage in the reset period according to the sustain pulse information. The duration of the floating state corresponds to the number of addressed cells called for in previous subfield data.

BRIEF DESCRIPTION OF THE DRAWINGS

The accompanying drawings, which are incorporated in and constitute a part of the specification, illustrate an embodiment of the invention, and, together with the description, serve to explain the principles of the invention:

FIG. 4(*b*) is a schematic diagram illustrating an equivalent circuit of the discharge cell of FIG. 4(*a*);

FIG. 4(*c*) is a schematic diagram of a discharge cell, similar to that shown in FIG. 4(*a*), illustrating a case in which no discharge occurs in the discharge cell;

FIG. 4(*d*) is a schematic diagram of a discharge cell, similar to that shown in FIG. 4(*a*), illustrating a state in which a voltage is applied when a discharge occurs in the discharge cell;

FIG. 4(*e*) is a schematic diagram of a discharge cell, similar to that shown in FIG. 4(*a*), illustrating a floated state when a discharge occurs in the discharge cell.

DETAILED DESCRIPTION

In the following detailed description, only certain exemplary embodiments of the invention will be described. As will be realized, the invention is capable of modification in various respects, all without departing from the invention. Accordingly, the drawings and description are to be regarded as illustrative in nature, rather than restrictive.

Figure 1:
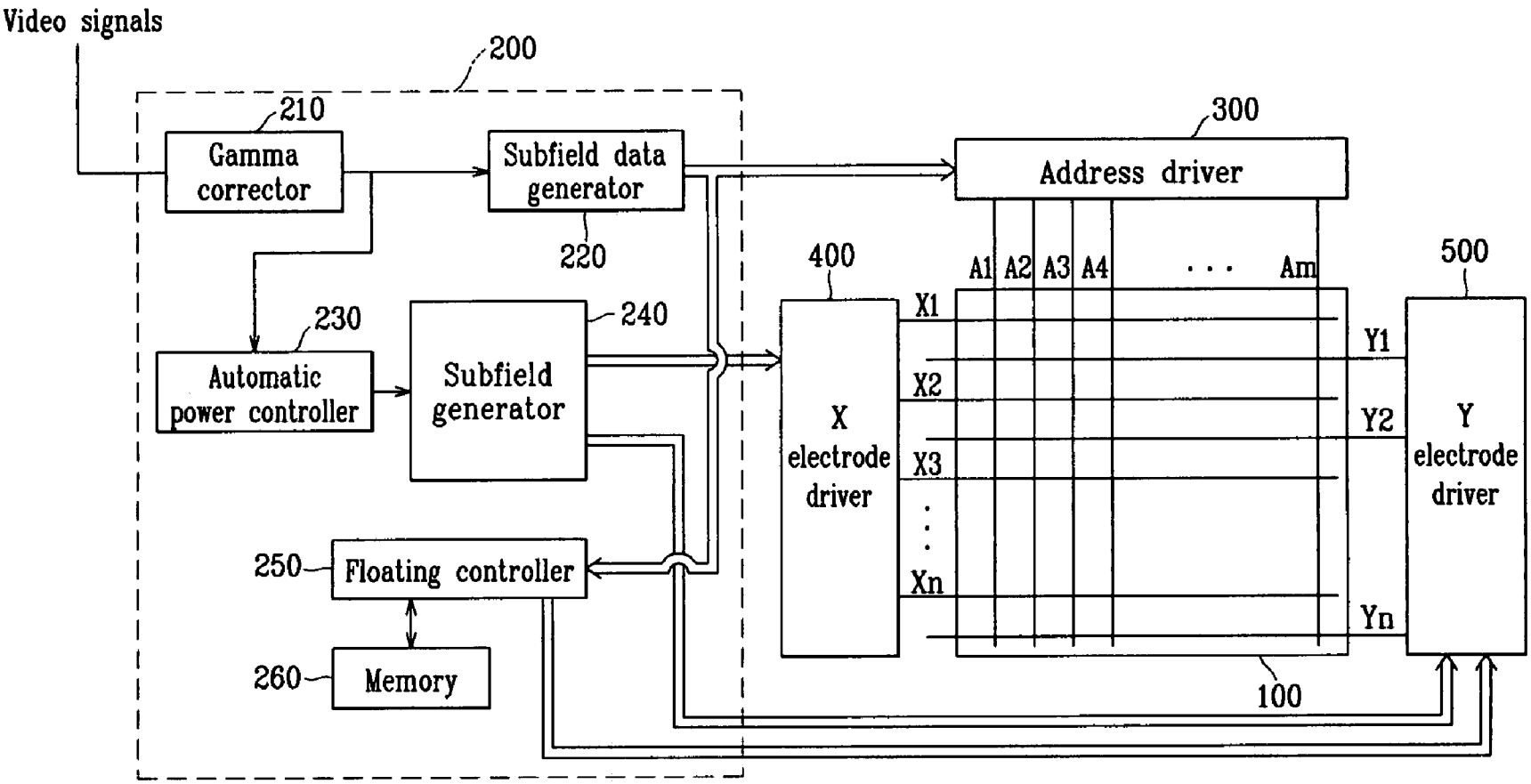
FIG. 1 is a schematic diagram of a PDP according to one embodiment of the present invention.

FIG. 1 is a schematic diagram of a PDP according to one embodiment of the present invention, illustrating its configuration. As shown, the PDP comprises a plasma panel 100, a controller 200, an address driver 300, a sustain electrode driver 400 (referred to as an X electrode driver hereinafter), and a scan electrode driver 500 (referred to as a Y electrode driver hereinafter).

The plasma panel 100 comprises a plurality of address electrodes A1 through Am arranged in the column direction, a plurality of sustain electrodes X1 through Xn (referred to as X electrodes hereinafter) arranged in the row direction, and a plurality of scan electrodes Y1 through Yn (referred to as Y electrodes hereinafter) arranged in the row direction. The X electrodes X1 through Xn correspond to the respective Y electrodes Y1 through Yn, and the ends are of the X electrodes X1 through Xn are coupled in common. The plasma panel 100 includes a glass substrate (not illustrated) on which the X and Y electrodes X1 through Xn and Y1 through Yn are arranged, and a glass substrate (not illustrated) on which the address electrodes A1 through Am are arranged. The two glass substrates face each other with a discharge space therebetween so that the Y electrodes Y1 through Yn may cross the address electrodes A1 through Am and the X electrodes X1 through Xn may cross the address electrodes A1 through Am. In this instance, discharge spaces on the crossing points of the address electrodes A1 through Am and the X and Y electrodes X1 through Xn and Y1 through Yn form discharge cells. The discharge space between the two substrates is sealed, and is filled with a gas.

The controller 200 receives external video signals, and outputs address driving control signals, X electrode driving control signals, and Y electrode driving control signals. Additionally, the controller 200 divides a single frame into a plurality of subfields and drives them, and each subfield sequentially includes a reset period, an address period, and a sustain period.

The address driver 300 receives address driving control signals from the controller 200, and applies display data signals to the respective address electrodes A1 through Am that cause particular discharge cells to be selected and addressed. The X electrode driver 400 receives X electrode driving control signals from the controller 200, and applies driving voltages to the X electrodes X1 through Xn. The Y electrode driver 500 receives Y electrode driving control signals from the controller 200, and applies driving voltages to the Y electrodes Y1 through Yn.

As shown in FIG. 1, the controller 200 comprises a gamma corrector 210, a subfield data generator 220, an automatic power controller 230, a subfield generator 240, a floating controller 250, and a memory 260.

The gamma corrector 210 receives video signals, corrects their gamma according to the characteristics of the POP, and outputs corrected video signals. The automatic power controller 230 measures the average signal level (ASL) of the video data output by the gamma corrector 210, controls power according to the measured ASL, and outputs power control data. The subfield generator 240 generates a number of subfields from the power control data, and outputs sustain pulse information for each subfield. The subfield data generator 220 processes the video signals to create subfield data that correspond to the subfields, and outputs the subfield data to the address driver 300. The memory 260 stores the number of addressed cells called for in the subfield data, and also stores a floating time which corresponds to the number of addressed cells called for in the subfield data. The floating controller 250 refers to the memory 260, and outputs a floating control signal to the Y electrode driver 500 so as to control the floating by using the floating time stored in the memory 260, which corresponds to the number of addressed cells called for by the subfield data. It is not necessary that the function ascribed to the floating controller 250 be vested in a controller per se; rather, the function of the floating controller 250 can be included in the function of the subfield generator 240, which connects and outputs to the Y electrode driver 500.

The details of driving a POP in an embodiment of the present invention will be described in detail below with reference to FIGS. 2-5(*b*). First, the gamma corrector 210 of the controller 200 receives external video signals, corrects their gamma according to the characteristics of the POP, and outputs corrected video signals. The automatic power controller 230 measures an ASL of the video data output by the gamma corrector 210, controls power according to the measured ASL, and outputs power control data. The subfield generator 240 generates a number of subfields from the power control data, and outputs sustain pulse information to the X and Y electrode drivers 400 and 500 for each subfield.

During this process, the memory 260 stores the number of addressed cells called for in the subfield data that is output by the subfield generator 240. Additionally, the memory 260 previously stores the floating times that correspond to the number of addressed cells called for in subfield data. That is, a table or other data structure containing the data values is stored therein so that the floating time may be increased as the number of the addressed cells called for in the subfield data decreases.

Exemplified table data stored in the memory 260 are given below.

| Load Ratio | Turn On cell | On Steps (Number of times) | Floating Time (μs) | Reset Time (μs) |
|---|---|---|---|---|
| 100% | 1226880 | 12 | 10 | 120 |
| 90% | 1104192 | 12 | 10.25 | 123 |
| 80% | 981504 | 12 | 10.5 | 126 |
| 70% | 858816 | 12 | 10.75 | 129 |
| 60% | 736128 | 12 | 11 | 132 |
| 50% | 613440 | 12 | 11.25 | 135 |
| 40% | 490752 | 12 | 11.5 | 138 |
| 30% | 368064 | 12 | 11.75 | 141 |
| 20% | 245376 | 12 | 12 | 144 |
| 10% | 122688 | 12 | 12.5 | 150 |
| 0% | 0 | 12 | 13 | 156 |

In this instance, the load ratio is obtained from the equation of (turned-on cells/total cells)×100 (%), OnSteps is a repeated number of floating and voltage applying, and it is assumed that the voltage is instantly applied.

As was described above, a reset operation generates the optimal wall charge state for the address operation. The discharge is naturally quenched by the state of the wall charges within the cells, and the discharge voltage is varied when the floating reset is applied. In this instance, when the number of addressed cells and previous subfield data is relatively few, the voltage variation in the floating state is minimized. However, when the number of addressed cells called for in the data is large, the voltage variation is increased, and the reset time is increased. Therefore, as the number of the addressed cells called for in the previous subfield data is increased, the floating time is reduced to increase the gradient of the floating, and when the number of addressed cells called for in the previous subfield data is relatively few, the floating time is increased and the gradient of the floating is allowed to be gradual. Optimum values for the floating time which correspond to the number of addressed cells of the previous subfield data are determined by simulation and are stored in the memory 260 in a table or other appropriate data structure. The above-noted table or other data structure is realized in a control program format.

The floating controller 250 refers to the memory 260, and outputs a floating control signal to the Y electrode driver 500 so as to control the floating when the scan electrode voltage is applied for the current subfield, by using a floating time that corresponds to the number of the addressed cells of the previous subfield data. As was noted above, the function of the floating controller 250 can be performed by the subfield generator 240, in which case, the requisite information would be included in the sustain pulse information output by the subfield generator 240 to drive the Y electrode driver 500.

The address driver 300 receives the subfield data, and applies the display data signals to select discharge cells to be activated. Appropriate voltages are sent to the respective address electrodes A1 to Am.

The X electrode driver 400 receives the sustain pulse information from the subfield generator 240 and applies a driving voltage to the X electrodes X1 to Xn. The Y electrode driver 500 receives the sustain pulse information and applies a driving voltage to the Y electrodes Y1 to Yn. The Y electrode driver 500 applies a discharge voltage to the Y electrodes during the reset period, performs floating, and repeats these operations. The floating time is determined according to the floating control signal.

The address electrodes A1 to Am arranged in the column direction, and the X and Y electrodes X1 to Xn and Y1 to Yn arranged in the row direction respectively receive signals from their respective controllers, and the plasma panel 100 displays corresponding data.

In the above-described process, the floating time of the reset period is controlled depending on the number of the turned-on cells of the subfield data, and the reset operation is accurately performed. The particular driving waveforms applied to the address electrodes A1 through Am, the X electrodes X1 through Xn, and the Y electrodes Y1 through Yn for each subfield are shown in and will be described with reference to FIGS. 2 to 3(*b*). A discharge cell formed by an address electrode, an X electrode, and a Y electrode will also be described below.

Figure 2:
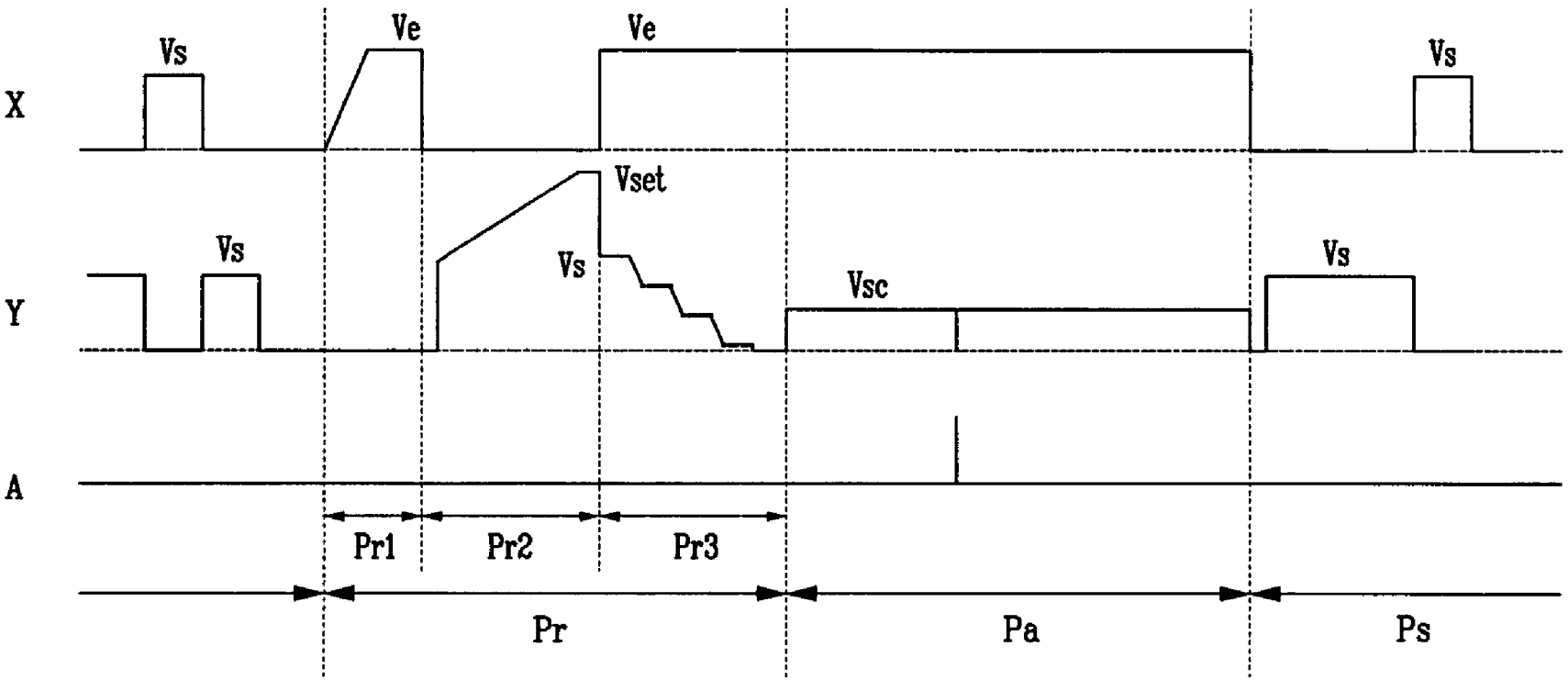
FIG. 2 is a waveform diagram illustrating driving waveforms used with PDPs according to embodiments of the present invention.
Figure 3A:
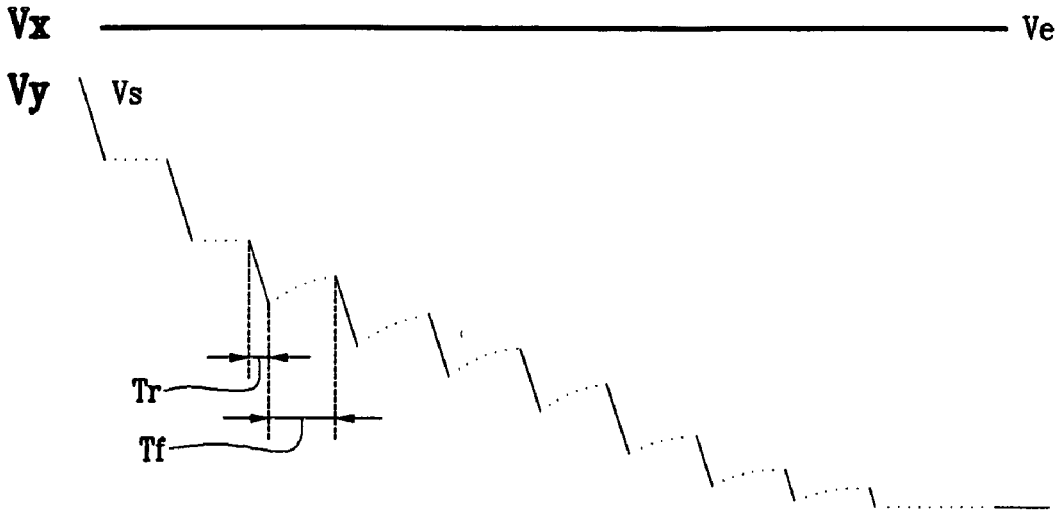
FIGS. 3(*a*) and 3(*b*) are waveform diagrams illustrating falling ramp waveforms with floating times according to an embodiment of the present invention.
Figure 3B:
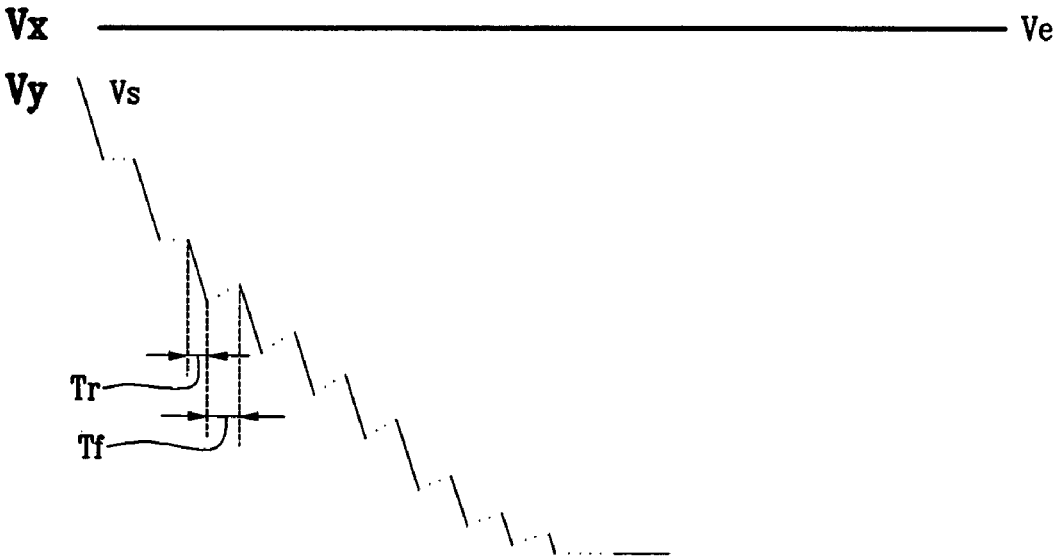
Figure 4A:
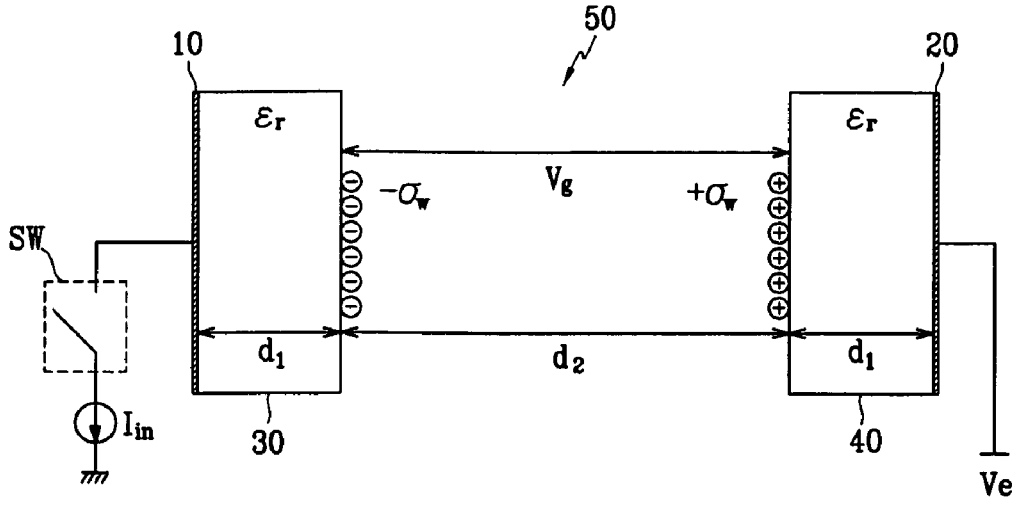
FIG. 4(*a*) is a schematic diagram of a discharge cell formed by a sustain electrode and a scan electrode, illustrating charges collected at the electrodes.
Figure 4B:
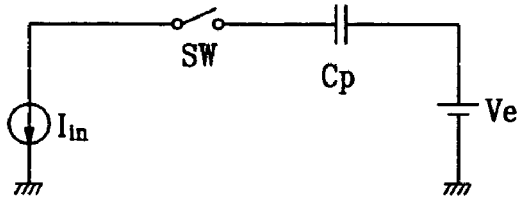
Figure 4C:
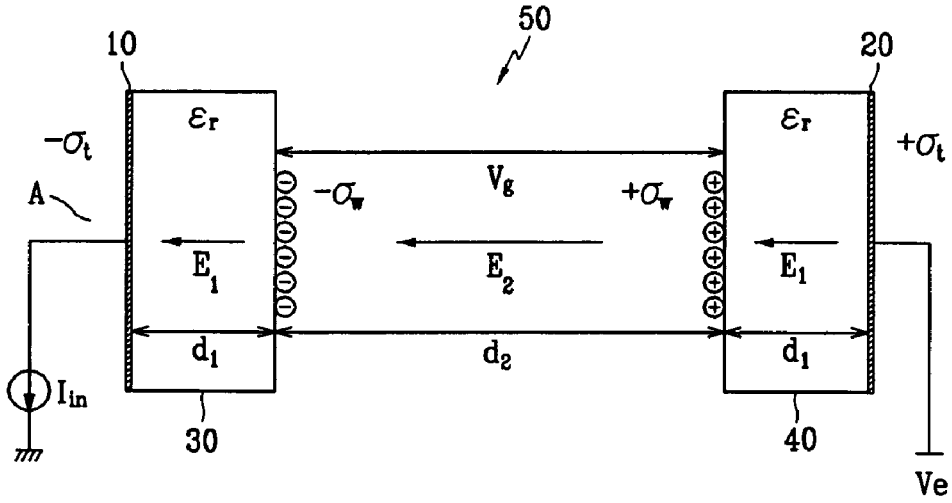
Figure 4D:
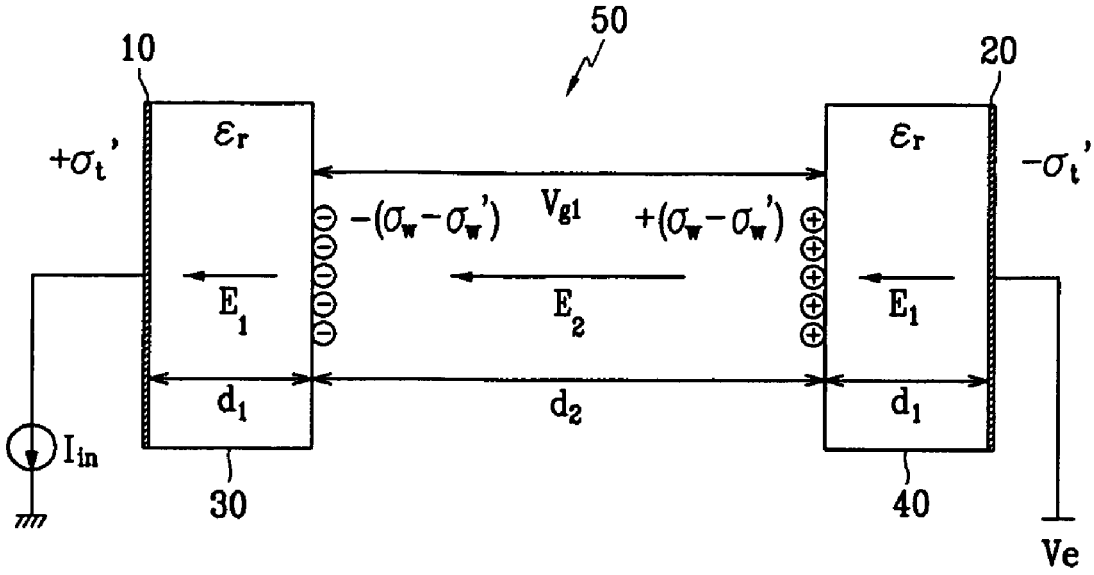
Figure 4E:
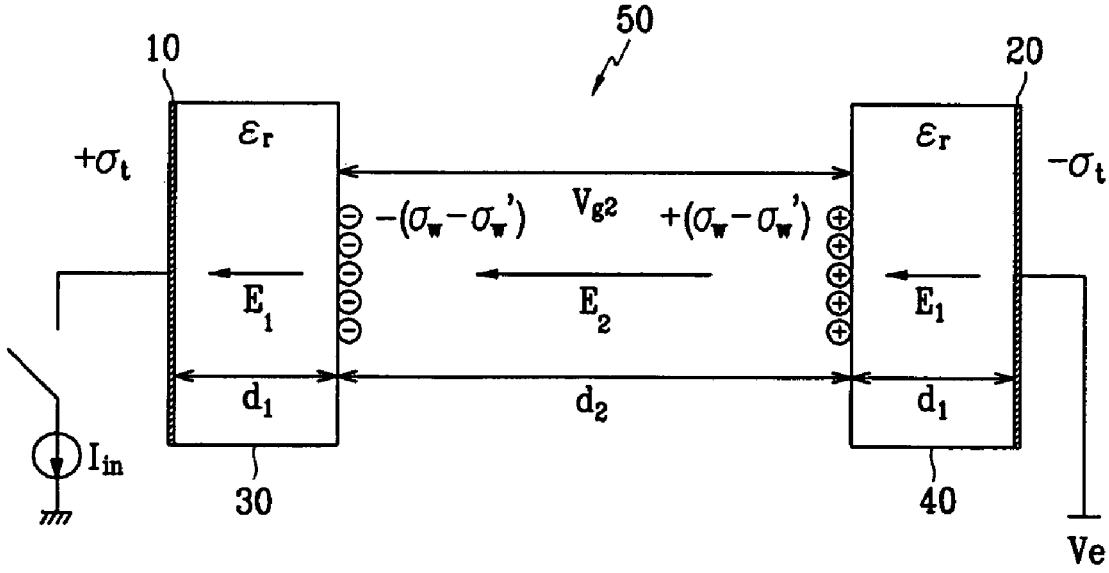

FIG. 2 is a waveform diagram illustrating a driving waveform used with a PDP according to an embodiment of the present invention, and FIGS. 3(*a*) and 3(*b*) are waveform diagrams illustrating voltages at the electrodes caused by the driving waveform shown in FIG. 2.

As shown in FIG. 2, a single subfield includes a reset period Pr, an address period Pa, and a sustain period Ps. The reset period Pr includes an erase period Pr1, a rising ramp period Pr2, and a falling ramp period Pr3.

In general, positive charges are formed at the X electrode, and negative charges are formed at the Y electrode when the last sustain pulse is finished in a sustain period. A ramp waveform rising from a reference voltage to a voltage of Ve is applied to the X electrode while the Y electrode is maintained at the reference voltage after the sustain period is finished in the erase period Pr1 of the reset period Pr, assuming that the reference voltage is 0V (volts). The charges accumulated at the X and Y electrodes are gradually erased.

Next, a ramp waveform rising from a voltage of Vs to a voltage of Vset is applied to the Y electrode while the X electrode is maintained at 0V in the rising ramp period Pr2 of the reset period Pr. A weak resetting discharge is generated between the address electrode and the Y electrode and between the X electrode and the Y electrode, causing negative charges to be accumulated at the Y electrode and positive charges to be accumulated at the address electrode and the X electrode.

As shown in FIGS. 2 to 3(*b*), a falling/floating voltage is applied to the Y electrode while the X electrode is maintained at the voltage of Ve in the falling ramp period Pr3 of the reset period Pr repeatedly so that the voltage Vs is reduced by a predetermined voltage and floated until it reaches the reference voltage. Thus, the voltage applied to the Y electrode is rapidly reduced during the period Tr, and the voltage applied to the Y electrode is stopped during the period Tf to float the Y electrode. The periods Tr and Tf are repeated until the voltage reaches the reference voltage.

When the voltage difference between the voltage Vx at the X electrode and the voltage Vy at the Y electrode becomes greater than the discharge firing voltage Vf while repeating the periods Tr and Tf, a discharge occurs between the X and Y electrodes. That is, a discharge current Id flows in the discharge space. When the Y electrode is floated after the discharge begins between the X and Y electrodes, the wall charges formed at the X and Y electrodes are reduced, the voltage within the discharge space is sharply reduced, and strong discharge quenching is generated within the discharge space. When the process of applying falling voltages and then floating the Y electrode is repeated a predetermined number of times, desired amounts of wall charges are formed at the X and Y electrodes.

In this instance, it is desirable for the falling voltage applying period Tr to be short so as to appropriately control the wall charges. That is, when the period Tr in which the voltage is applied is lengthy, a strong discharge is formed, and the amount of wall charges that are produced may be difficult to control with a single discharge and floating cycle. If this happens, it may be difficult to control the wall charges in general.

As was described above, the floating time is controlled depending on the number of addressed cells called for in the previous subfield data. FIG. 3(*a*) is a waveform diagram illustrating a case in which the reset operation is performed by increasing the floating time when the number of the turned-on cells of the previous subfield data is relatively few. FIG. 3(*b*) is a waveform diagram illustrating a case in which the reset operation is performed by decreasing the floating time when the number of the turned-on cells of the previous subfield data is large.

FIGS. 4(*a*) through 4(*e*), are schematic diagrams of a discharge cell and its circuit equivalent, illustrating the strong discharge quenching caused by floating using methods according to embodiments of the invention. This quenching will be described below in detail with reference to the X and Y electrodes in the discharge cell, since the discharge generally occurs between the X and Y electrodes.

FIG. 4(*a*) is a schematic diagram of a discharge cell formed by a sustain electrode and a scan electrode, FIG. 4(*b*) is a circuit diagram illustrating an equivalent circuit of FIG. 4(*a*), FIG. 4(*c*) is a schematic diagram similar to FIG. 4(*a*) illustrating a case when no discharge occurs in the discharge cell of FIG. 4(*a*), FIG. 4(*d*) is a schematic diagram similar to FIG. 4(*a*) illustrating a state in which a voltage is applied when a discharge occurs in the discharge cell of FIG. 4(*a*), and FIG. 4(*e*) is a schematic diagram similar to FIG. 4(*a*) illustrating a floated state when a discharge occurs in the discharge cell of FIG. 4(*a*). For ease of description, charges $-\sigma_w$ and $+\sigma_w$ are assumed to be formed at the Y and X electrodes 10 and 20, respectively, in a stage earlier than that shown in FIG. 4(*a*). The charges are actually formed on a dielectric layers covering the electrodes, but for ease of explanation, the charges are described as being formed at or on the electrode.

As shown in FIG. 4(*a*), the Y electrode 10 is coupled to a current source in through a switch SW, and the X electrode 20 is coupled to the voltage of Ve. Dielectric layers 30 and 40 are respectively formed on the Y and X electrodes 10 and 20. Discharge gas (not illustrated) is injected between the dielectric layers 30 and 40, and the area provided between the dielectric layers 30 and 40 forms a discharge space 50.

In this instance, since the Y and X electrodes 10 and 20, the dielectric layers 30 and 40, and the discharge space 50 form a capacitive load, they can be illustrated and taken as a panel capacitor Cp, as shown in FIG. 4(*b*). The dielectric constant of the dielectric layers 30 and 40 is defined as $\epsilon_r$, the voltage at the discharge space 50 is Vg, the thickness of the dielectric layers 30 and 40 is the same as d1, and the distance between the dielectric layers 30 and 40 (i.e., the height or distance of the discharge space) is d2.

The voltage Vy applied to the Y electrode of the panel capacitor Cp is reduced in proportion to the time when the switch SW is turned on as given in Equation (1). That is, when the switch SW is turned on, a falling voltage is applied to the Y electrode 10.

$$Vy = Vy(0) - \frac{I_{in}}{C_p} t \qquad \text{Equation (1)}$$

where Vy(0) is the Y electrode voltage Vy when the switch SW is turned on, and Cp is the capacitance of the panel capacitor.

Assuming that the voltage applied to the Y electrode 10 is Vin, the voltage Vg applied to the discharge space 50 when no discharge occurs while the switch SW is turned on can be calculated as follows. This state is shown in FIG. 4(*c*). When the voltage of Vin is applied to the Y electrode 10, the charges $-\sigma_1$ are applied to the Y electrode 10, and the charges $+\sigma_1$ are applied to the X electrode 20. By applying the Gaussian theorem, the electric field E1 within the dielectric layers 30 and 40 and the electric field E2 within the discharge space 50 can be described as shown in Equations (2) and (3).

$$E_1 = \frac{\sigma_t}{\varepsilon_\gamma \varepsilon_0} \qquad \text{Equation (2)}$$

where $\sigma_1$ is charges applied to the Y and X electrodes, and $\epsilon_0$ is a permittivity within the discharge space.

$$E_2 = \frac{\sigma_t + \sigma_w}{\varepsilon_0} \qquad \text{Equation (3)}$$

The voltage (Ve-Vin) applied outside is given as Equation (4) which describes the relationship between the electric field and the distance, and the voltage of Vg of the discharge space 50 is given as Equation (5).

$$2d_1E_1 + d_2E_2 = V_e - V_{in} \qquad \text{Equation (4)}$$

$$V_g = d_2E_2 \qquad \text{Equation (5)}$$

From Equations 2 through 5, the charges a, applied to the Y or X electrode 10 or 20 and the voltage Vg within the discharge space 50 are given, respectively, as Equations (6) and (7).

$$\sigma_t = \frac{V_e - V_{in} - \frac{d_2}{\varepsilon_0}\sigma_w}{\frac{d_2}{\varepsilon_0} + \frac{2d_1}{\varepsilon_\gamma \varepsilon_0}} = \frac{V_e - V_{in} - V_w}{\frac{d_2}{\varepsilon_0} + \frac{2d_1}{\varepsilon_\gamma \varepsilon_0}} \qquad \text{Equation (6)}$$

where Vw is a voltage formed by the wall charges $\sigma_w$ in the discharge space 50.

$$V_g = \frac{\varepsilon_\gamma d_2}{\varepsilon_\gamma d_2 + 2d_1}(V_e - V_{in} - V_w) + V_w = \alpha(V_e - V_{in}) + (1-\alpha)V_w \qquad \text{Equation (7)}$$

In actuality, since the internal length d2 within the discharge space 50 is a very large value compared to the thickness d1 of the dielectric layers 30 and 40, $\alpha$ almost reaches 1. That is, it is known from Equation (7) that the externally applied voltage of (Ve-Vin) is applied to the discharge space 50.

Next, with reference to FIG. 4(*d*), the voltage Vg1 within the discharge space 50 is calculated when the wall charges formed at the Y and X electrodes 10 and 20 are quenched by the amount of $\sigma'_w$ because of the discharge caused by the externally applied voltage of (Ve-Vin). The charges applied to the Y and X electrodes 10 and 20 are increased to $\sigma'_1$ since charges are supplied from the power Vin so as to maintain the potential of the electrodes when the wall charges are formed.

By applying the Gaussian theorem to the situation shown in FIG. 4(*d*), the electric field E1 within the dielectric layers 30 and 40 and the electric field E2 within the discharge space 50 are given as Equations (8) and (9).

$$E_1 = \frac{\sigma'_t}{\varepsilon_\gamma \varepsilon_0} \qquad \text{Equation (8)}$$

-continued $$E_2 = \frac{\sigma'_t + \sigma_w - \sigma'_w}{\varepsilon_0} \quad \text{Equation (9)}$$

Using Equations (8) and (9), the charges $\sigma'_T$ applied to the Y and X electrodes 10 and 20 and the voltage Vg1 within the discharge space are given as Equations (10) and (11).

$$\sigma'_t = \frac{V_e - V_{in} - \frac{d_2}{\varepsilon_0}(\sigma_w - \sigma'_w)}{\frac{d_2}{\varepsilon_0} + \frac{2d_1}{\varepsilon_\gamma \varepsilon_0}} = \frac{V_e - V_{in} - V_w + \frac{d_2}{\varepsilon_0}\sigma'_w}{\frac{d_2}{\varepsilon_0} + \frac{2d_1}{\varepsilon_\gamma \varepsilon_0}} \quad \text{Equation (10)}$$

$$V_{g1} = d_2 E_2 = \alpha(V_e - V_{in}) + (1-\alpha)V_w - (1-\alpha)\frac{d_2}{\varepsilon_0}\sigma'_w \quad \text{Equation (11)}$$

Since $\alpha$ is almost 1 in Equation (11), very little voltage drop is generated within the discharge space 50 when the voltage Vin is externally applied to generate a discharge. Therefore, when the amount $\sigma'_w$ of the wall charges quenched by the discharge is very large, the voltage Vg1 within the discharge space 50 is reduced, and the discharge is quenched.

Next, with reference to FIG. 4(*e*), the voltage Vg2 within the discharge space 50 is calculated when the switch SW is turned off (i.e., the discharge space 50 is floated) after the wall charges formed at the Y and X electrodes 10 and 20 are quenched by the amount of $\sigma'_w$ because of the discharge caused by the externally applied voltage Vin. Since no external charges are applied, the charges applied to the Y and X electrodes 10 and 20 become $\sigma_T$ in the same manner as that shown and described with reference to FIG. 4(*c*). By applying the Gaussian theorem, the electric field E1 within the dielectric layers 30 and 40 and the electric field E2 within the discharge space 50 are given by Equations (2) and (12).

$$E_2 = \frac{\sigma_t + \sigma_w - \sigma'_w}{\varepsilon_0} \quad \text{Equation (12)}$$

Using Equations (12) and (6), the voltage Vg2 of the discharge space 50 is given as Equation (13).

$$V_{g2} = d_2 E_2 = \alpha(V_e - V_{in}) + (1-\alpha)V_w - \frac{d_2}{\varepsilon_0}\sigma'_w \quad \text{Equation (13)}$$

It is known from Equation (13) that a large voltage drop is generated by the quenched wall charges when the switch SW is turned off (floated). That is, as known from Equations (12) and (13), the intensity of the voltage drop caused by the wall charges with the Y electrode 10 floated becomes greater by a multiple of 1/(1-$\alpha$) times than that of the state in which voltage is applied. As a result, since the voltage within the discharge space 50 is substantially reduced in the floated state when a small amount of charges are quenched, the voltage between the Y and X electrodes 10 and 20 is reduced to below the discharge firing voltage, and the discharge is steeply quenched. That is, the operation of floating the Y electrode 10 after the discharge starts functions as a steep discharge quenching mechanism. When the voltage within the discharge space 50 is reduced, the voltage Vy at the floated Y electrode 10 is increased by a predetermined voltage as shown in FIGS. 3(*a*) and 3(*b*) since the X electrode 20 is fixed at the voltage of Ve.

Referring to FIGS. 3(*a*) and 3(*b*) again, when the Y electrode is floated in the state when the Y electrode voltage falls to cause a discharge, the discharge is quenched while the wall charges formed at the Y and X electrodes are slightly quenched according to the discharge quenching mechanism. By repeating this operation, the wall charges formed at the Y and X electrodes are erased step by step, thus allowing the wall charges to reach a desired state. In other words, by this technique, the wall charges are accurately controlled to achieve a desired wall charge state in the falling ramp period Pr3 of the reset period Pr.

In this embodiment, the Y electrode is floated during the falling ramp period Pr3 of the reset period Pr; however, embodiments of the invention may control the wall charges by using the falling ramp waveform, or they may control the wall charges by using the rising ramp waveform. An embodiment in which the electrode is floated during the rising ramp period Pr2 will be described below.

FIGS. 5(*a*) and 5(*b*) are waveform diagrams illustrating a rising ramp waveform and a discharge current according to another embodiment of the present invention. As shown in FIGS. 2, 5(*a*) and 5(*b*), a repeatedly applied cycle of rising and floating voltages that causes an increase of the voltage from Vs to Vset by a predetermined voltage can be applied to the Y electrode while the X electrode is maintained at 0V in the rising ramp period Pr2 of the reset period Pr. In this embodiment, the voltage applied to the Y electrode is quickly increased by a predetermined amount during the period Tr, and the no voltage applied to the Y electrode during the period Tf, causing the Y electrode to be electrically floated. As shown in FIGS. 5(*a*) and 5(*b*), the periods Tr and Tf are repeated.

When the voltage difference between the voltage Vy at the Y electrode and the voltage Vx at the X electrode is greater than the discharge firing voltage Vf during the repeated Tf and Tr periods, discharge between the X and Y electrodes is generated. When the Y electrode is floated after the discharge between the X and Y electrodes, the voltage within the discharge space is substantially reduced, and strong discharge quenching occurs in the discharge space. Positive charges are formed at the X electrode and negative charges are formed at the Y electrode because of the discharge between the X and Y electrodes. In this instance, the voltage Vy at the floated Y electrode is reduced by a predetermined voltage because the voltage within the discharge space is reduced as described above.

When the rising voltage and floating periods are repeated a predetermined number of times, desired amounts of wall charges are formed at the X and Y electrodes. Generally, it is desirable for the period Tr of applying the rising voltage to be short so as to appropriately control the wall charges, as described above.

Figure 5A:
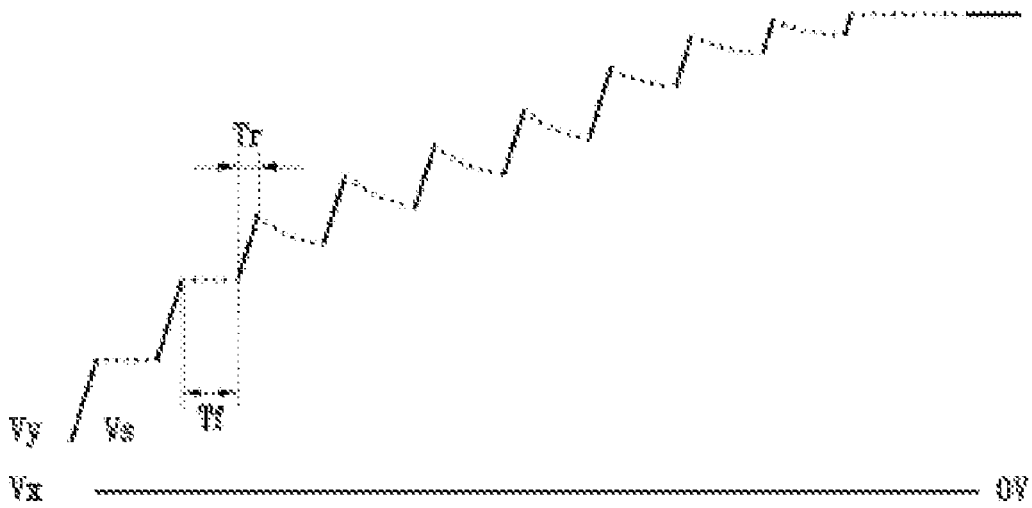
FIGS. 5(*a*) and 5(*b*) are waveform diagrams illustrating rising ramp waveforms using floating times according to embodiments of the present invention.
Figure 5B:
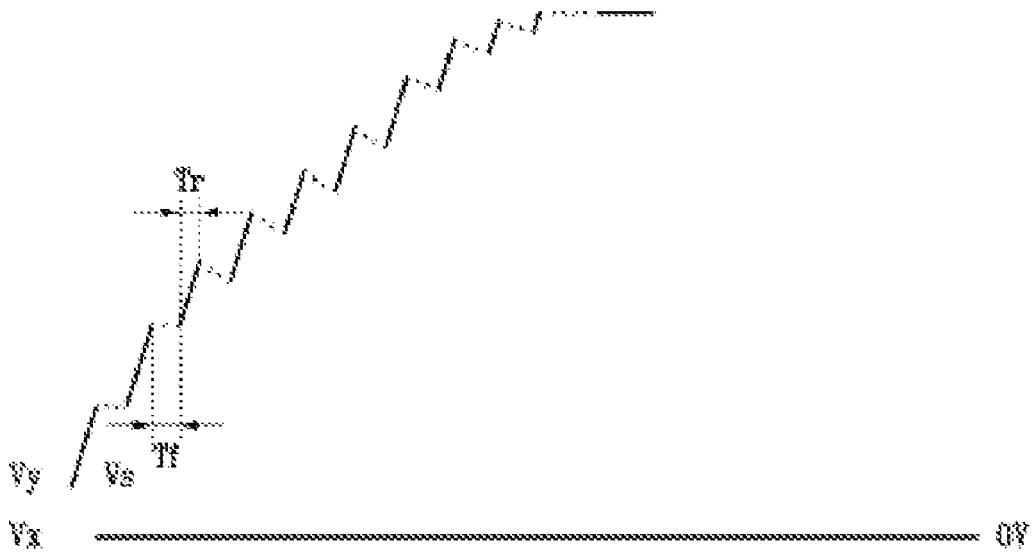

As described above, the floating time is controlled depending on the number of addressed cells called for in the previous subfield data. FIG. 5A illustrates a case in which the reset operation is performed by increasing the floating time when the number of addressed cells called for in the previous subfield data is relatively few, and FIG. 5B illustrates a case in which the reset operation is performed by decreasing the floating time when the number of the turned-on cells of the previous subfield data is large.

According to embodiments of the present invention, voltage is applied and the floating time is determined according to the number of addressed cells called for in the previous subfield data, and the floating operation is repeated when applying the rising or falling ramp waveform. This allows the reset operation to be performed within the defined reset period, while allowing appropriate control over the wall charges.

Moreover, the reset operation can be performed within the defined reset period, and the wall charges can be appropriately controlled as desired, by determining the voltage applying time according to the number of addressed cells called for in the previous subfield data as well as the floating time, and repeating the voltage applying and floating periods.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display panel, comprising:

a plurality of address electrodes, and corresponding plurralities of scan electrodes and sustain electrodes arranged in pairs;

a controller adapted to accept external video signals and generate and output subfield data and sustain pulse information corresponding to the respective subfields, control voltage application such that a floating state for floating at least one electrode during a floating period and a voltage application state for changing a voltage of the at least one electrode during a voltage application period are repeatedly alternated such that the voltage of the at least one electrode is changed from a first voltage to a second voltage in the reset period, control the voltage application period or the floating period according to the subfield data, the subfield data comprising at least the number of addressed cells called for in previous subfield data, and output a control signal embodying the control of voltage application and the control of the voltage application time or floating time;

an address data driver adapted to apply a voltage that corresponds to the subfield data to the address electrode;

a sustain electrode driver adapted to apply sustain voltages to the sustain electrode according to the sustain pulse information output by the controller; and a scan electrode driver adapted to apply scan voltages to the scan electrode according to the sustain pulse information, wherein the controller is adapted to control the floating period such that the floating period is reduced when the number of addressed cells called for in the previous subfield data is increased.

2. The plasma display panel of claim 1, wherein the controller comprises:

an automatic power controller adapted to output power control data to control the power according to a load ratio of the external video signals;

a subfield generator adapted to generate a number of subfields from the power control data, and to output sustain pulse information for each subfield;

a subfield data generator adapted to transform the external video signals into the subfield data, and to output the subfield data;

a memory adapted to store the voltage application period or the floating period that corresponds to the number of addressed cells called for in the previous subfield data; and a floating controller adapted to refer to the memory, and to output the control signal to the scan electrode driver so that the floating state and the voltage application state are repeatedly alternated in at least one of the scan electrodes to create a scan electrode floating period and a scan electrode voltage application period.

3. The plasma display panel of claim 2, wherein the scan electrode driver allows the scan electrode floating period to be greater in duration than the scan electrode voltage application period, and drives the scan electrode by reducing the floating period as the number of addressed cells called for in the previous subfield data is increased.

4. The plasma display panel of claim 1, wherein the controller is adapted to:

create a rising ramp waveform which causes a voltage of at least one of the scan electrodes to rise from a third voltage to a fourth voltage while causing the sustain electrode to be maintained at a fifth voltage during a rising ramp period of the reset period, and apply a falling/floating voltage that comprises one or more instances of the floating state and one or more instances of the voltage application state to the at least one of the scan electrodes such that the voltage of the at least one of the scan electrodes is changed from the first voltage to the second voltage, and maintain the sustain electrode at a sixth voltage during a falling ramp period of the reset period.

5. The plasma display panel of claim 4, wherein the second voltage is a reference voltage.

6. The plasma display panel of claim 4, wherein the sixth voltage is greater than the sustain voltages.

7. A plasma display panel that translates input video signals into subfield data, divides each subfield datum into a reset period, an address period, and a sustain period, and produces an image using the subfield data, comprising:

a first electrode, a second electrode, and a third electrode;

one or more discharge spaces defined, at least in part, by the first electrode, the second electrode, and the third electrode; and a driving circuit adapted to transmit a driving signal to the first and second electrodes during the reset period, the driving signal causing a floating state for floating the first electrode and a voltage application state for changing a voltage of the first electrode to be repeatedly alternated such that a voltage of the first electrode is changed from a first voltage to a second voltage during the reset period, wherein the duration of the floating state is reduced when a number of addressed cells called for in previous subfield data is increased.

8. The plasma display panel of claim 7, wherein the first electrode is a scan electrode, the second electrode is a sustain electrode, and the third electrode is an address electrode, and the driving circuit transmits a rising ramp waveform signal which rises from the first voltage to a third voltage to the scan electrode while maintaining the sustain electrode at a fourth voltage during a rising ramp period of the reset period, and applies a falling/floating voltage to the scan electrode that comprises one or more instances of the floating state and one or more instances of the voltage application state such that the voltage of the scan electrodes is changed from the first voltage to the second voltage while maintaining the sustain electrode at a fifth voltage during a falling ramp period of the reset period.

9. The plasma display panel of claim 8, wherein the driving circuit allows the floating state to be longer in duration than the voltage application state.

10. A method for driving a plasma display panel including a first space defined by a first electrode, a second electrode, and a third electrode, comprising:

(a) creating a number of subfields from input video signals, dividing each subfield into a reset period, an address period, and a sustain period; and (b) applying a voltage which repeats a floating state for the first electrode and a voltage application state for changing a voltage of the first electrode to cause the voltage at the first electrode to move from a first voltage to a second voltage in the reset period, wherein a duration of the floating state corresponds to the number of addressed cells called for in previous subfield data, and the duration of the floating state is reduced as the number addressed cells called for in the previous subfield data is increased.

11. The method of claim 10, wherein the duration of the floating state for the first electrode is greater than the duration of the voltage application state.

12. A method for driving a plasma display panel, comprising:

applying a voltage to a first electrode in a discharge cell defined by the first electrode and at least a second electrode, repeatedly alternating a floating state for floating the first electrode and a voltage application state for changing a voltage of the first electrode so as to change the voltage of the first electrode from a first voltage to a second voltage during a reset period of the plasma display panel such that a duration of the floating state is reduced when the number of addressed cells called for in previous subfield data is increased.

13. The method of claim 12, wherein the first electrode is a scan electrode and the second electrode is a sustain electrode, and the sustain electrode is biased at a constant voltage during the floating state and the voltage application state.

14. The method of claim 13, wherein the first voltage is greater than the second voltage, and a period for the floating state is longer in duration than a period for the voltage application state.

15. The method of claim 13, wherein the first voltage is less than the second voltage, and a period for the floating state is longer in duration than a period for the voltage application state.

* * * * *